US005785865A

United States Patent [19]

Salis

[11] Patent Number: 5,785,865

[45] Date of Patent: Jul. 28, 1998

[54] WATERCRAFT WASTE WATER TREATMENT SYSTEM AND METHOD

[76] Inventor: Giorgio Salis, Via Satta 72, I-09127 Cagliari, Italy

[21] Appl. No.: 761,722

[22] Filed: Dec. 6, 1996

[30] Foreign Application Priority Data

Dec. 20, 1995 [IT] Italy ..... TO95 A 001029

[51] Int. Cl.[6] ..... E03F 5/10

[52] U.S. Cl. ..... 210/747; 210/170; 210/242.1; 210/538; 210/920; 141/284; 405/210

[58] Field of Search ..... 210/170, 241, 210/242.1, 257.1, 521, 538, 747, 920; 141/65, 284; 405/210

[56] References Cited

U.S. PATENT DOCUMENTS

| | | | |
|---|---|---|---|
| 3,528,462 | 9/1970 | Quase | 141/284 |
| 3,590,887 | 7/1971 | Quase | 141/284 |
| 3,703,960 | 11/1972 | Kennedy | 210/121 |
| 3,730,884 | 5/1973 | Burns et al. | 210/170 |
| 3,820,488 | 6/1974 | Johnson | 114/0.5 R |
| 3,870,634 | 3/1975 | Humphrey | 210/241 |
| 3,875,051 | 4/1975 | Kovarik | 210/170 |
| 4,332,681 | 6/1982 | Jambry et al. | 210/170 |
| 4,525,277 | 6/1985 | Poulin | 210/241 |
| 4,999,103 | 3/1991 | Bogart | 210/241 |
| 5,059,066 | 10/1991 | Schindler | 405/210 |

*Primary Examiner*—Christopher Upton
*Attorney, Agent, or Firm*—D. Peter Hochberg; Mark Kusner

[57] ABSTRACT

A waste water treatment system for wharf-mooring or riding-at-anchor vessels, boats, ships and watercraft in general, comprising a number of tanks adapted to be submerged and each provided with a respective drawing tube having a connector plug for watertight connection to a waste water outlet of a respective boat or the like. The tanks are connected to a self-contained purification installation for intaking and treating the sewage.

8 Claims, 2 Drawing Sheets

WATERCRAFT WASTE WATER TREATMENT SYSTEM AND METHOD

Figure 1:
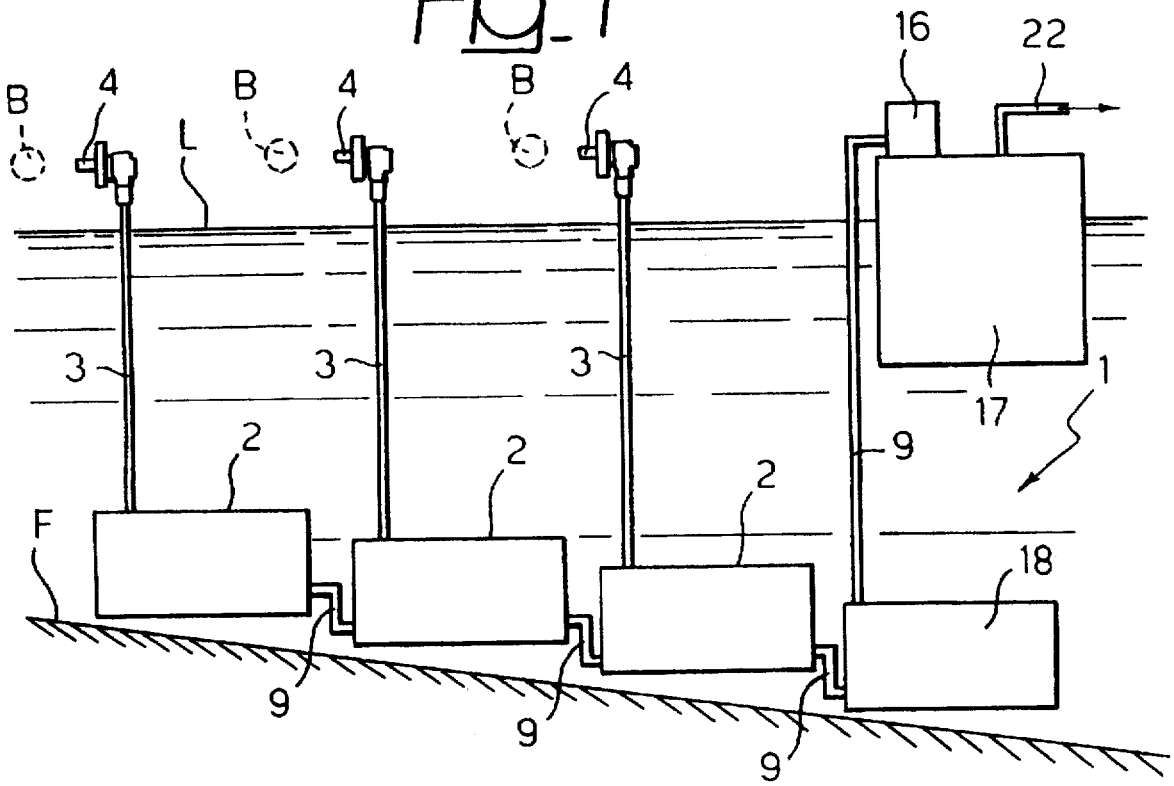

The present invention is generally related to disposal of waste waters of vessels, boats, ships and watercrafts in general (in the following, for the sake of brevity, simply designated as "boats"), mooring at wharf or riding at anchor.

Traditionally, the solution to the problem of disposal of polluting sewage consists of providing boats with on-board more or less complicated purification installations, and of storage containers for the polluting substances. Systems of this type are disclosed and illustrated, for instance, in U.S. Pat. No. 4,121,993, U.S. Pat. No. 4,071,445 and U.S. Pat. No. 4,038,184.

These conventional solutions proved however inadequate, firstly because the sewage of on-board containers must anyway be subsequently discharged in open sea or removed by means of specific equipment which may not warrant a sufficient degree of efficiency. Moreover the conventional systems are unsuitable for application to small watercrafts or pleasure-boats, in which evidently the room necessary for the storage of large amounts of polluting-sewage is not available.

The object of the present invention is to give a solution to the above-referenced problem, i.e. to provide a particularly simple, functional, practical and economical system enabling disposal of polluting sewage from boats, in general during the stay in a harbour, haven or marina, without any risks of environmental pollution and without the need of providing on-board containers for storing the sewage.

A further object of the invention is to provide a waste water treatment system for boats in general, which is able to perform a widespread collecting service without any operation limit during the boat stay.

A further object of the invention is to provide a waste water treatment system for boats in general, having a movable modular design arrangement, adapted to be installed and removed in a simple and quick way, and in practice without any negative effects on the environment.

According to the invention, these objects are achieved essentially by virtue of a waste water treatment system for wharf-mooring or riding-at-anchor boats and the like conventionally provided with waste water outlets, primarily characterised in that it comprises a number of tanks adapted to be submerged and laid on the bottom of a water basin, each tank being provided with a respective drawing tube having a connector plug for watertight connection into a waste water outlet of a corresponding boat or the like, and a self-contained purification installation connected, through suction means, to said tanks.

The invention contemplates two different alternative embodiments of the system, in the first of which the tanks are connected to one another in series, and in the second of which the tanks are instead connected to one another in parallel. In both cases a supplementary connection tank, interposed between said number of tanks and the purification installation, may additionally be provided.

Each tank is normally formed with an inner compartmenting for a first separation of the liquids which are lighter than water, and is further conveniently formed with a ballast box to be flooded for immersion thereof. A suitable pneumatic pumping system may be provided for emptying the ballast box, and thus for surfacing of the tanks.

The purification installation may be located on land or in the water, for instance at the end of a wharf or pier, and may also be movable and transportable. More conveniently, the purification installation is carried on board of a service boat.

Accordingly, the installation may also be transferred, in a relative short time, from one area to another or a harbour or marina, depending upon the operation need.

Figure 3:
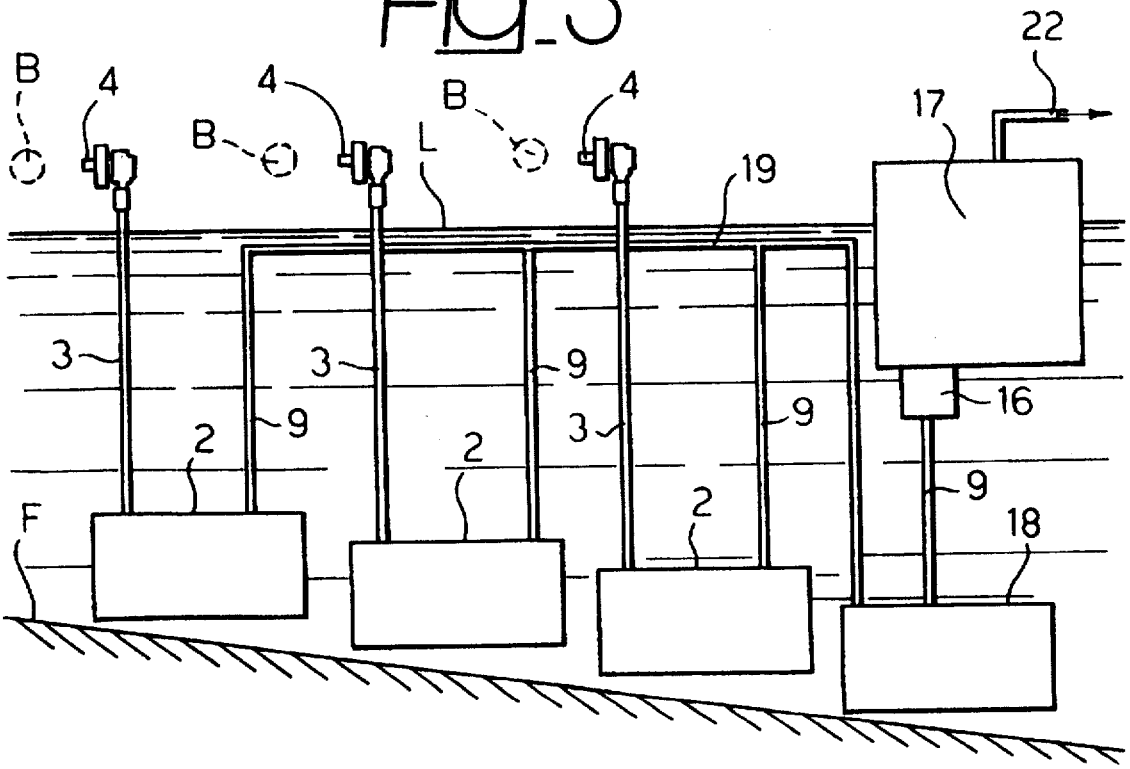
Figure 4:
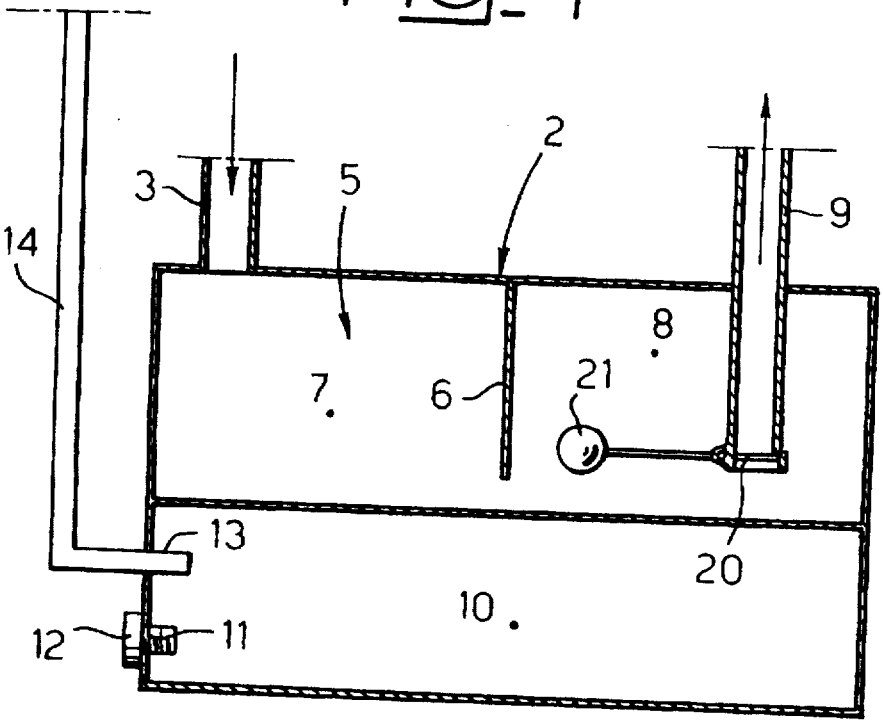
Figure 2:
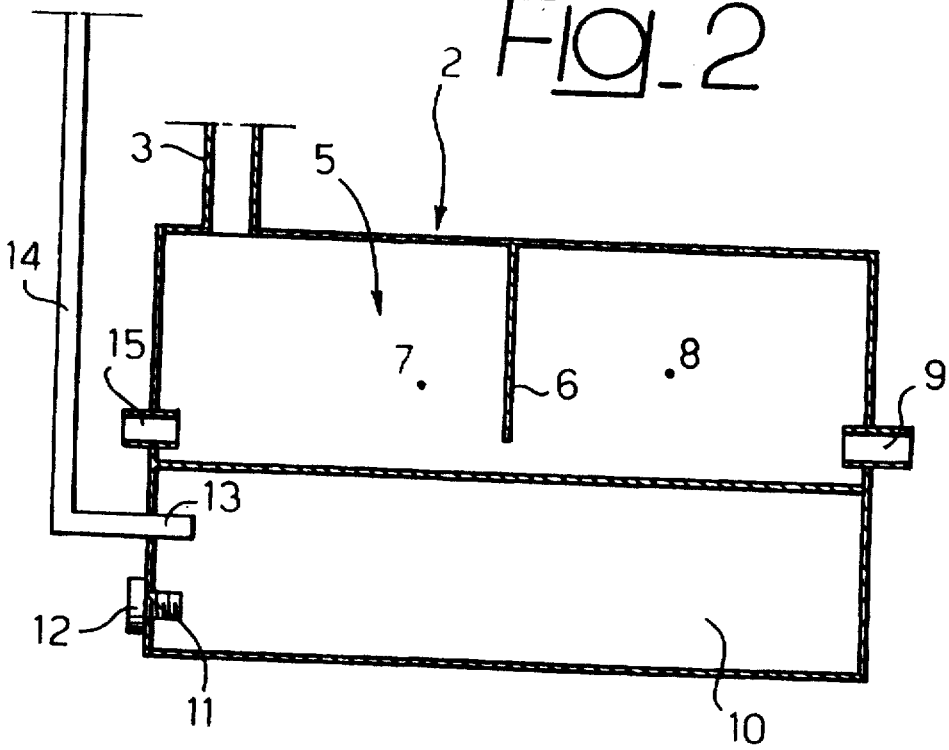

Further features and advantages of the invention will become apparent through the following detailed description, with reference to the accompanying drawings, purely provided by way of non limiting example, in which:

FIG. 1 is a diagrammatic and fragmentary view of a treatment system according to a first embodiment of the invention, FIG. 2 is a vertically sectioned and enlarged view of one of the tank in the system according to FIG. 1, FIG. 3 shows a variant of FIG. 1, and FIG. 4 is a vertically sectioned and enlarged view of one of the tank in the system according to FIG. 3.

Referring initially to FIGS. 1 and 2, a system according to the invention for treatment of the waste waters of wharf-mooring or riding-at-anchor vessels, boats, ships and watercrafts in general, is generally designated as 1. In FIG. 1, the line depicted as S indicates the surface of a water basin, for instance of a sea or lake harbour, the bottom of which is further indicated as F.

References B diagrammatically indicate waste water outlets of a number of boats at their moorings or at anchor.

The treatment system 1 is based upon the principle of drawing out from the outlets B the liquid sewage produced on board of the boats, namely white, grey and black waste waters, .and convey same to purification. The sewage are piped towards submerged tanks laid on the bottom F and connected to one another, and then drawn away and treated by a self-contained water purifying apparatus.

In detail, the system 1 comprises a plurality of tanks 2, the number of which is variable as a function of the operation need, each of which is provided with a respective drawing tube 3 having at its free end a connector plug 4 designed for watertight connection into the water outlet B of a corresponding boat or the like.

Each connector plug 4, which is provided with a pneumatic or mechanical retaining device within the outlet B, should satisfy the following requirements and perform the following functions:

- remain fitted within the water outlet B without damaging thereof;
- resist to the operation pressures;
- automatically disengage after use, without any need of outside intervention.

Each submerged tank 2 should satisfy the following requirements and functions:

- resist to the underwater pressure;
- having an inner compartmenting for a first separation of oils, or anyhow of the liquids lighter than water;
- having a further inner compartmenting designed to allow, by means of a hydro-pneumatic method, immersion and emersion.

In more detail, and specifically referring to FIG. 2, each tank 2 has a generally box-like configuration, normally with an iron-ore cement structure, defining an inner volume 5 for sewage collection. This inner volume 5 is subdivided, by a partial intermediate partition wall 6, into an inlet chamber 7 communicating with the tube 7, and an outlet chamber 8 communicating with a suction pipe 9. The partition wall 6 enables in operation to carry out a first separation of the lighter-than-water liquids, for instance oils and the like, which are then retained in correspondence of the inlet chamber 7.

The tank 2 is further provided in its lower area, or in any other suitable portion thereof, with a ballast box 10 which can be flooded and emptied so as to perform immersion and, at the end of operation, emersion thereof. This ballast box 10 is to be connected to the outside through a passage 11 within which a valve 12 is fitted, formed for instance by a screw plug displaceable between an open position and a closed position. Moreover the ballast box 10 is provided with a tubular connector 13 for connection thereof to a hose 14 for the supply of compressed air.

Referring again to FIG. 1, in the embodiment disclosed herein the tanks 2 are connected in series to one another, in the sense that the suction pipe 9 of the first tank 2 is also connected to an inlet 15 of the second tank 2, and so on.

The suction pipe 9 of the last tank 2 is connected to a suction pump 16 associated to a purifying apparatus 17 which is to be located either in water, or at the end of a wharf and/or pier, or on board of a service boat, or on land. The connection between the last tank 2 and the purifying apparatus 17 may be direct or, more conveniently, may be performed through a final supplementary tank 18, whose configuration is same as the tanks 2.

The purifying apparatus 17 may be of any conventional type, provided it is suitable for the specific application. For instance, the purifying apparatus 17 can be of the micro-bubbles type.

In operation, the system 1 can easily be transported and then installed—even as a non-permanent installation—in the selected area of the water basin. Of course the whole basin (harbour and/or marina) can be equipped with the system 1 (or with a series of identical systems 1), as a permanent installation.

For setting up the system it is simply necessary to flood the ballast boxes 10 of the tanks 2, after positioning the plugs 12 in the open position, and submerge the tanks.

These tanks 2 shall thus be laid on the bottom F, and their precise positioning shall if necessary be completed with the aid of scuba divers.

The purifying apparatus 17 and related suction pump 16 shall normally be maintained constantly in operation. The connector plugs 4 shall in turn be connected to the water outlets B of the boats at their moorings in correspondence of respective tanks 2. Thus the liquid sewage produced thereon is drawn out and conveyed through the tubes 3 into the submerged tanks 2 and subsequently transferred from one tank 2 to the adjacent one, via the suction pipes 9, so as to reach, directly or through the auxiliary tank 18, the purifying apparatus 17. In practice, each tank 2 thus acts as a temporary sewage storage container during transfer thereof from the boat to the purifying apparatus 17.

The water purified and cleaned by the purifying apparatus 17 can be then discharged into the basin, through an outlet duct 22.

In the absence of boats or the like at their moorings, the system 1 can be removed or, alternatively, even employed for water purification of the basin itself. In the first case, a diver shall set the plugs 12 of all tanks 2 are in the open position, and then the ballast boxes 10 shall be emptied by introducing compressed air therein through the hoses 14. Upon floating of the tanks 2 on the water surface, the diver himself shall position the respective plugs 12 in the closed condition, so as to ensure buoyancy and subsequent removal thereof.

In the second case the basin water can be sucked through the tanks 2 either keeping the respective connector plugs 4 in immersed condition, or providing the tanks 2 with respective water inlet valves equipped with vacuum-openable devices. In the latter case the connector plugs 4 shall evidently be closed or isolated with respect to the related tubes 3.

The above-disclosed example referred to FIGS. 1 and 2 is related, as explained, to the case in which the tanks 2 are connected to one another in series. Different connections are however envisageable, such as the parallel connection shown in FIG. 3, in which parts which are identical or similar to those previously disclosed are designated by the same numeral references. In this variant a joint suction pipe 9 is provided, which is connected to the purifying apparatus 17 directly or through the supplementary tank 18, and to which the suction pipes 9 of the various tanks 2 are connected in parallel.

The design of these tanks 2, shown in detail in FIG. 4, differs from that previously disclosed only for the fact that the end of each suction pipe 9 is provided with a check valve 20, for instance comprising a tiltable plate obturator controlled by a float 21, for automatically closing communication between the tank 2 and the joint suction pipe 19 when the level of the sewage collected therein decreases below a predetermined value. Accordingly each tank 2 can be automatically isolated from the suction pump 16 when the action thereof becomes unnecessary.

It will be apparent from the foregoing that the treatment system according to the invention leads to the following advantageous results:

- employing the underwater bottom as the volume for storing the polluting sewage, laying down thereon a number of tanks which, continuously emptied, supply a self-contained purifying apparatus;
- connecting the user boats to an outer volume for discharging the polluting sewage thereof, which outer volume shall then be available for further user boats;
- relieving the user boats from any polluting responsibility, whenever same are not equipped on board of prescribed storage tanks;
- providing, even for the user boats having proper on-board installation, a widespread drawing out service without any use limits during their stay;
- providing a simple, flexible and relatively cheap treatment installation, which is also easily transportable, is adapted to be installed and removed in a short time, and which in any case has no negative environmental effect.

Naturally, the details of construction and the embodiments may be widely varied with respect to what has been disclosed and illustrated, without thereby departing from the scope of the present invention, such as defined in the appended claims.

What is claimed is:

1. A system for treatment of waste water of wharf-mooring or riding-at-anchor vessels, boats, ships and watercrafts provided with waste water outlets, comprising a number of tanks, each of said tanks having a rigid structure, a ballast box integrally formed in each of said tanks for submerging the tanks to the bottom of a water basin, outlet pipes extending from each tank and connecting said tanks, each tank being provided with a respective drawing tube having a connector plug for watertight connection into a waste water outlet of a corresponding watercraft, movable self contained purification installation means installed on board of a boat and suction means connecting said purification installation means to said tanks, wherein said system is displaceable from one location to another location.

2. System according to claim 1, wherein said tanks have respective outlet pipes connected in series to one another.

3. System according to claim 1, wherein said tanks have respective outlet pipes connected in parallel to one another.

4. System according to claim 3, wherein a respective check valve is associated to each of said outlet pipes for automatically closing communication thereof with said suction means when the waste water contents within the tank decreases below a predetermined level.

5. System according to claim 1, further comprising a supplementary collecting tank interposed between said number of tanks and said purification installation means.

6. System according to claim 1, wherein each tank is formed with an inner compartmenting for a first separation of the lighter-than-water liquids.

7. System according to claim 1, further comprising an emptying pneumatic system connected to said ballast box of each tank for emersion thereof.

8. A method for treating waste water from wharf-mooring or riding-at-anchor vessels, boats, ships and watercrafts in general equipped with waste water outlets, comprising the following steps:

providing a movable purification installation means, moving the purification installation means onto the surface of a boat, providing a plurality of movable and rigid underwater tanks, at least one tank being connected to said purification installation means and at least one tank being connected to one other tank, said tanks having an integral ballast box and having a tube for watertight connection from outside to at least one waste water outlet, flooding the ballast box of said tanks and causing said tanks to sink, connecting at least one of said tubes with at least one of said waste water outlets so as to collect waste water into said at least one underwater tank, and sucking out the waste water collected into said at least one underwater tank for delivery thereof to said purification installation means.

* * * * *